United States Patent [19]

Laios et al.

[11] Patent Number: 4,698,982

[45] Date of Patent: Oct. 13, 1987

[54] AIR CONDITIONING UNIT WITH REVERSIBLE DRAIN PAN AND RETURN AIR PANEL

[75] Inventors: Sotirios D. Laios, Rivervale; Daniel P. Werner, Allendale, both of N.J.

[73] Assignee: Automation Industries, Inc., Darien, Conn.

[21] Appl. No.: 926,673

[22] Filed: Nov. 4, 1986

[51] Int. Cl.[4] ..... F25D 21/14

[52] U.S. Cl. ..... 62/286; 29/157 R; 29/401.1; 29/469; 62/298; 62/326; 165/76; 165/913; 220/4 R

[58] Field of Search ..... 62/298, 286, 291, 326; 165/76, 111, 913; 220/4 R, 4 F; 29/401.1, 157, 469

[56] References Cited

U.S. PATENT DOCUMENTS

| | | | |
|---|---|---|---|
| 2,822,674 | 2/1958 | Simmons | 62/140 |
| 3,357,763 | 12/1967 | Toper | 62/298 X |
| 3,596,475 | 9/1969 | Berger | 62/285 |
| 3,628,590 | 12/1971 | Knebusch | 62/290 |
| 3,678,993 | 7/1972 | Pierce | 165/76 |
| 3,977,467 | 8/1976 | Northrup, Jr. | 62/286 X |
| 4,088,466 | 5/1978 | Humphrey et al. | 62/286 |
| 4,129,013 | 12/1978 | Hine, Jr. | 62/285 |
| 4,151,726 | 5/1979 | Schlueter | 62/285 |
| 4,474,232 | 10/1984 | Wright et al. | 165/137 |
| 4,549,405 | 10/1985 | Anderson et al. | 62/298 X |
| 4,554,796 | 11/1985 | Stankard | 62/326 |

*Primary Examiner*—William E. Tapolcai
*Attorney, Agent, or Firm*—Francis N. Carten

[57] ABSTRACT

An air-conditioning unit which can be converted from a horizontal air flow configuration to a vertical air flow configuration (or vice-versa) at the installation site without any additional parts or special tools. A reversible drain pan and return (intake) air panel forms part of the air-conditioning unit adjacent to a slant-mounted cooling coil, and may be demounted, reoriented and remounted so as to move the return (intake) air panel from one end of the unit to one side of the unit (or vice-versa). The air-conditioning unit is then tilted 90° so as to position the drain pan under the cooling coil.

9 Claims, 5 Drawing Figures

AIR CONDITIONING UNIT WITH REVERSIBLE DRAIN PAN AND RETURN AIR PANEL

SUMMARY OF THE INVENTION

The present invention is embodied in and carried out by an air-conditioning unit which may be configured for either vertical or horizontal air discharge. While being normally provided in the configuration for horizontal air discharge, the unit may be converted to the vertical configuration without any additional parts or special tools. This conversion is effected by partial disassembly of the unit so that the drain pan and return air panel assembly adjacent to a slant-mounted cooling coil may be reversed, i.e., rotated 180° about an axis perpendicular to the plane in which the cooling coil lies, so as to reposition the return air opening on one side of the unit instead of at one end of the unit. The drain pan is simultaneously relocated to the position previously occupied by the return air panel. After such repositioning and reassembly of the unit, it may be positioned for vertical installation.

DESCRIPTION OF THE DRAWINGS

The present invention may be better understood by reading the written description thereof with reference to the accompanying drawings, of which.

DETAILED DESCRIPTION OF THE INVENTION

In this application the phrase "air conditioning unit" is intended to include any system or part of a system for either cooling, heating, dehumidifying or moving air, or any combination of those functions. The word "air" is intended to mean air or any other gas(es).

Figure 1:
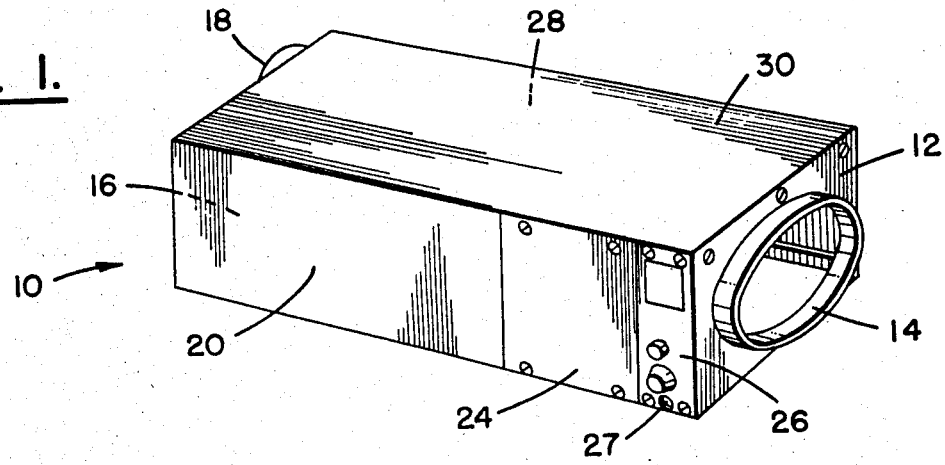
FIG. 1 shows the air-conditioning unit embodying the present invention in its horizontal configuration.

Referring specifically to FIG. 1, the air-conditioning unit 10 comprises a six-sided enclosure in which a first side 12 incorporates an air intake opening 14. A second side 16 incorporates an air exhaust opening 18. A third side is formed by a larger segment 20 and a smaller segment 22, the latter being joined with the first side 12 to form an L-shaped member. A fourth side is formed by a series of panels, including a coil access panel 24 and a refrigerant connector panel 26. An opening 27 is formed under conventional refrigerant connectors. A fifth side comprises the rear access panel 28 in which an opening may be formed by removal of a punch-out 29. A sixth side is formed by the top panel 30. A drain pan 32 is disposed along the inner surface of segment 22 and forms an integral part of the assembly including the drain pan 32, the segment 22, and the side 12 having the air intake opening 14 formed therein. The air-conditioning unit 10 is preferably frameless, with the various panels of the six-sided enclosure serving to support the weight of the components of the unit. The condensate falling into drain pan 32 from the cooling coil may be removed via the welded-in threaded coupling 33 to which a pipe or hose (not shown) may be attached through opening 27 to carry off the condensate. The side of the drain pan 32 which is adjacent to the corner of the L-shaped member is preferably slightly lower than the opposite side of the drain pan 32 so as to cause condensate to flow to the level of coupling 33. The remaining components of the unit are conventional, and are therefore not shown.

Figure 2:
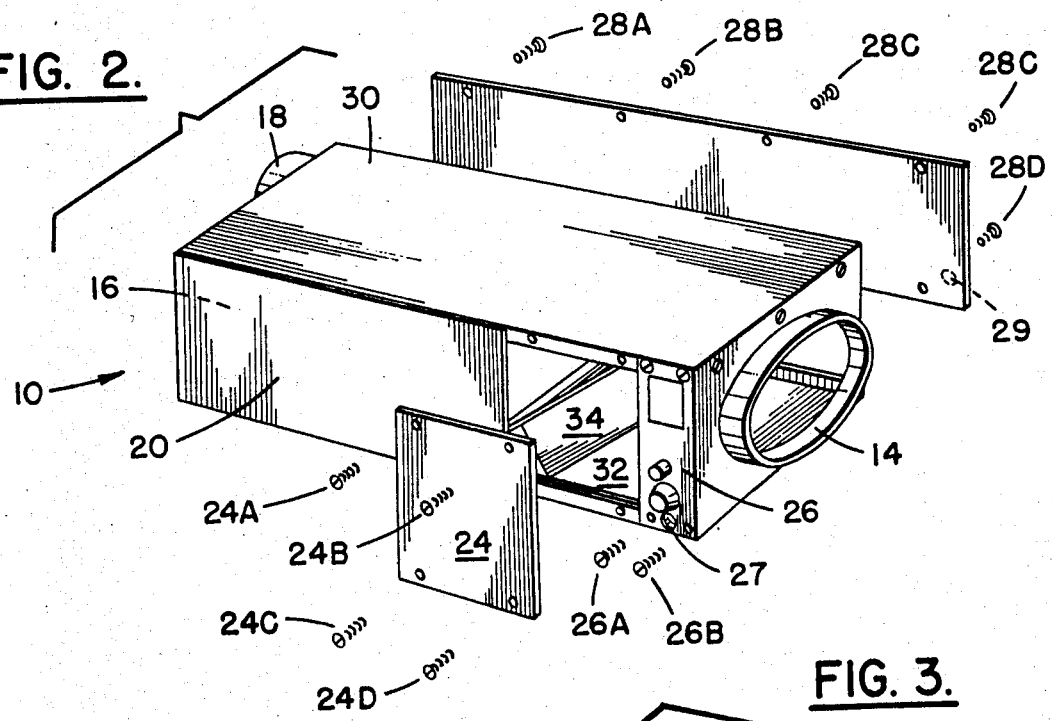
FIG. 2 shows the unit of FIG. 1 in the first stage of the reconfiguration process.
Figure 3:
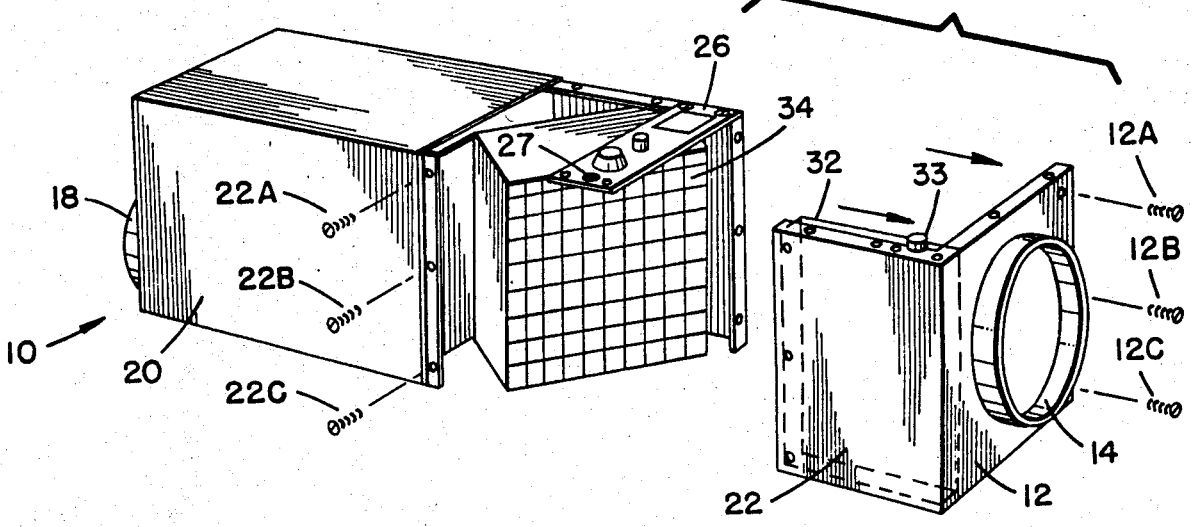
FIG. 3 shows the unit of FIG. 1 in the second stage of the reconfiguration process.
Figure 4:
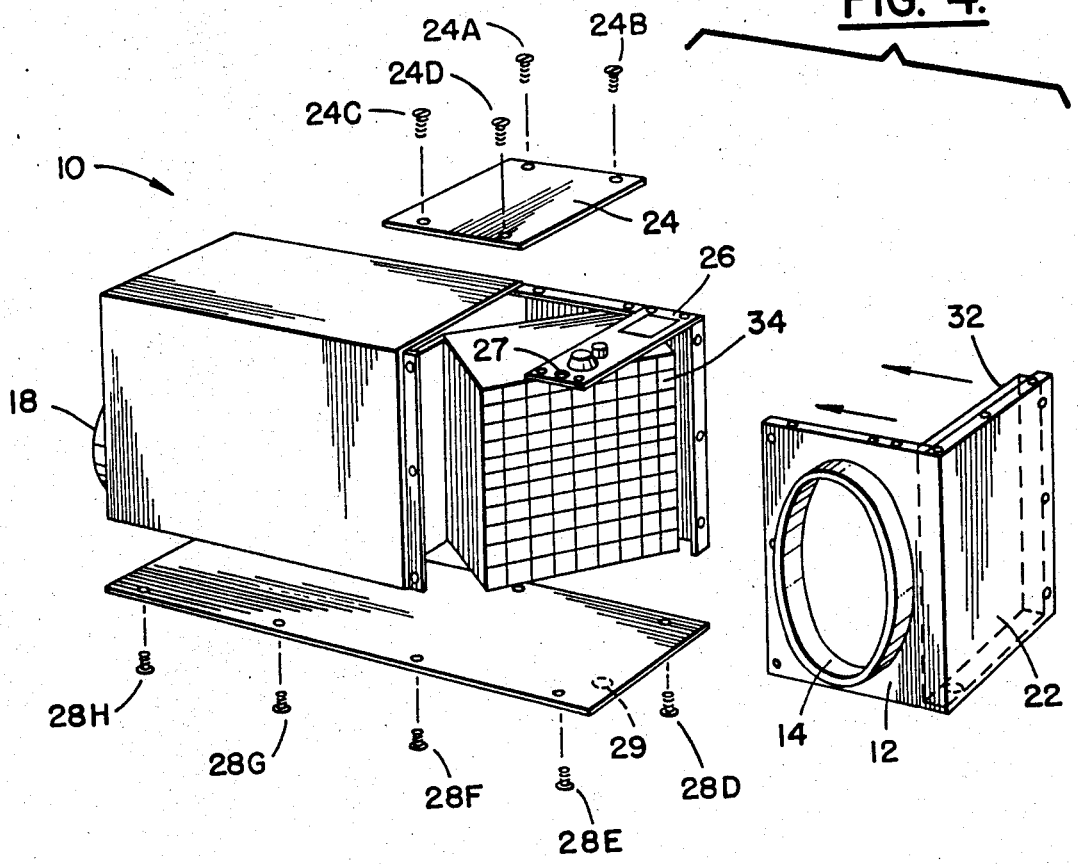
FIG. 4 shows the unit of FIG. 1 in the third stage of the reconfiguration process.
Figure 5:
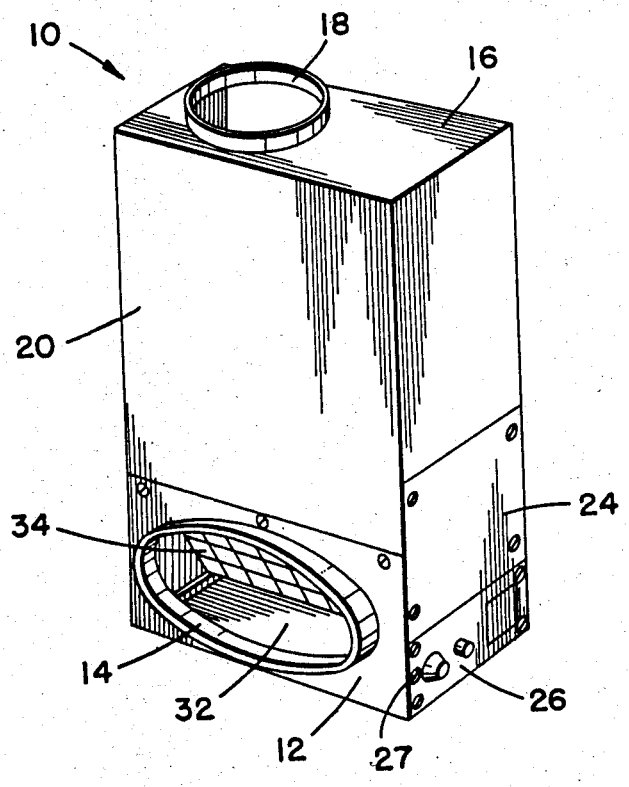
FIG. 5 shows the unit of FIG. 1 reconfigured and reoriented for vertical installation.

Referring now to FIGS. 2, 3 and 4, the sequence of operations for converting the air-conditioning unit 10 shown in FIG. 1 from a horizontal air flow configuration to a vertical air flow configuration is depicted. It will be seen that the rear access panel 28 is removed by removing a series of screws 28A–H. Similarly, the coil access panel 24 is removed by removing a series of screws 24A–D. The lower edge of connector panel 26 is detached by removal of screws 26A–B. The upper edge of side 12 is detached from the adjacent edge of the top panel 30 by removing a series of screws 12A–C, and the parallel edge of segment 22 is detached from the adjacent edge of larger segment 20 by removing a series of screws 22A–C. In this manner, the L-shaped assembly formed by side 12 and segment 22, incorporating the air intake opening 14 and drain pan 32, respectively, may be removed from the remainder of the air-conditioning unit 10 and reoriented so that, when remounted to the remainder of air conditioning unit 10, the side 12 is in the position previously occupied by segment 22, and vice-versa. Once this reorientation of the reversible assembly has been effected, the coil access panel 24 and rear access panel 28 may be replaced by means of their associated screws 24A–D and 28A–H. Before replacing rear access panel 28, the punch-out 29 must be removed to form an opening through which coupling 33 of drain pan 32 may be accessed. The lower edge of connector panel 26 is re-attached by screws 26A–B. The series of screws 12A–C and 22A–C are also replaced so as to fix the remaining edges of segment 22 and side 12 to the adjacent edges of top panel 30 and larger segment 20, respectively. As shown in FIG. 5, the final step is to tilt the air-conditioning unit 90° so as to position the drain pan 32 under the coil 34. The air intake opening 14 is now positioned on the third side of the unit 10, which is now reconfigured and repositioned for vertical air flow.

In the foregoing description and drawings, the present invention has been set forth with reference to the details of the preferred embodiment thereof. Nevertheless, it will be understood that those details are presented for the purpose of illustration, and are in no way intended to limit the scope of the invention. Numerous modifications can be made by those skilled in the art without departing from the scope of the invention. Specifically, although the foregoing description and drawings depict an air-conditioning unit for cooling and dehumidifying, the invention may readily be applied to heating units as well. In such an application, there would be no need for a drain pan, and the cooling coil would be a heating coil. Other modifications and applications will be apparent to those skilled in the art, and it is the intention of the present applicants to encompass all such modifications and applications within the scope of the claims set forth hereunder.

We claim:

1. In an air-conditioning unit comprising a six-sided enclosure having an air intake opening in a first side and an air exhaust opening in a second side, a coil mounted at an angle with respect to and adjacent the air intake opening, and a drain pan disposed within a third side and adjacent the coil and at an angle thereto, the improvement comprising: a reversible assembly including a first segment formed by said first side and a second segment formed by a portion of said third side, said air intake opening being formed in one of said segments, and said drain pan being disposed along the inner surface of the other of said segments, said reversible assembly being demountable for reorientation and remounting to the remainder of the air-conditioning unit so as to reposition said first segment in place of said second segment and vice-versa, said drain pan thereby being repositioned so as to be under the coil when the air-conditioning unit is tilted 90° with respect to its original position.

2. The improvement according to claim 1, wherein each of the six sides of said enclosure is disposed at right angles with respect to the adjacent sides, and said reversible assembly is L-shaped, with said first and second segments having substantially the same dimensions.

3. The improvement according to claim 2, wherein said coil is mounted at substantially a 45° angle with respect to both said air intake opening and said drain pan, regardless of the orientation of said reversible assembly.

4. The improvement according to claim 3, wherein said air-conditioning unit further comprises a coil access panel in a fourth side of said enclosure, a rear access panel forming a fifth side of said enclosure, and a sixth side parallel to and spaced apart from said third side, said reversible assembly being demountably attached to said coil access panel, to said rear access panel, and to said third and sixth sides so as to enable the reorientation and remounting of said reversible assembly.

5. The improvement according to claim 4, wherein a fluid connector panel is positioned at one end of the air-conditioning unit immediately adjacent to said coil access panel and between said third and sixth sides.

6. The improvement according to claim 1, wherein said air intake opening is formed in said first segment and said drain pan is disposed along the inner surface of said second segment.

7. The improvement according to claim 1, wherein said air intake opening is formed in said second segment and said drain pan is disposed along the inner surface of said first segment.

8. A method of converting an air-conditioning unit from horizontal air flow to vertical air flow, said air-conditioning unit comprising a six-sided enclosure having an air intake opening in a first side, an air exhaust opening in a second side, a coil mounted at an angle with respect to the first side and adjacent the air intake opening, a drain pan disposed adjacent to the coil and at an angle thereto, and a reversible assembly including said first side, said drain pan, and a portion of a third side of said enclosure attached and parallel to said drain pan, said method comprising essentially the following steps:

(1) demounting said reversible assembly from the remainder of the air-conditioning unit;
(2) reorienting said reversible assembly so as to reposition said first side in place of said portion of said third side and vice-versa;
(3) remounting said reversible assembly to the remainder of the air-conditioning unit;
(4) reorienting said air-conditioning unit so that said drain pan is positioned under said coil.

9. A method of converting an air-conditioning unit from vertical air flow to horizontal air flow, said air-conditioning unit comprising a six-sided enclosure having a drain pan disposed within a first side, an air exhaust opening in a second side, an air intake opening in a portion of a third side, a coil mounted adjacent to and at an angle with respect to both said drain pan and said air intake opening, and a reversible assembly including said first side, said drain pan, and said portion of a third side of having said air intake opening formed therein, said method comprising essentially the following steps:

(1) demounting said reversible assembly from the remainder of the air-conditioning unit;
(2) reorienting said reversible assembly so as to reposition said first side in place of said portion of said third side and vice-versa;
(3) remounting said reversible assembly to the remainder of the air-conditioning unit;
(4) reorienting said air-conditioning unit so that said drain pan is positioned under said coil.

* * * * *